US005250001A

United States Patent [19]

Hansen

[11] Patent Number: 5,250,001

[45] Date of Patent: Oct. 5, 1993

[54] TOY CONSTRUCTION KIT

[76] Inventor: Arni Hansen, Tungugöta 1, FO-100 Thorshavn, Faroe Islands,

[21] Appl. No.: 844,652

[22] PCT Filed: Oct. 3, 1990

[86] PCT No.: PCT/DK90/00251

§ 371 Date: Apr. 3, 1992

§ 102(e) Date: Apr. 3, 1992

[87] PCT Pub. No.: WO91/04775

PCT Pub. Date: Apr. 18, 1991

[30] Foreign Application Priority Data

Oct. 3, 1989 [DK] Denmark ..... 4847/89

[51] Int. Cl.[5] ..... A63H 33/12; A63H 33/08; E04B 1/10; F16C 11/06

[52] U.S. Cl. ..... 446/104; 446/122; 446/125; 52/233; 52/595; 403/163; 403/217; 24/697.1; 24/573.1

[58] Field of Search ..... 446/104, 102, 106, 68, 446/111, 116, 117, 118, 120, 121, 122, 125, 126, 69, 77, 105, 107; 52/109, 233, 536, 595; 403/161, 163, 171, 176, 217, 219; 24/662, 697.1, 573.1, 573.2, 453, 297

[56] References Cited

U.S. PATENT DOCUMENTS

| | | | |
|---|---|---|---|
| 1,248,068 | 11/1917 | Brunel | 446/104 |
| 2,446,018 | 7/1948 | Miskimen | 403/163 X |
| 2,589,588 | 3/1952 | Winnemore | 446/69 X |
| 2,961,779 | 11/1960 | Perry | 446/121 X |
| 3,168,793 | 2/1965 | Gibson | 446/126 X |
| 3,360,287 | 12/1967 | Wyse | 403/217 |
| 3,611,616 | 10/1971 | Einfalt | 446/69 |
| 3,626,634 | 12/1971 | Jones et al. | 446/121 X |
| 3,676,969 | 7/1972 | Moore | 446/106 X |
| 3,733,655 | 5/1973 | Kolibar | 24/573.2 X |
| 3,927,489 | 12/1975 | Bernstein | 446/104 |
| 3,972,550 | 8/1976 | Baughton et al. | 24/697.1 X |
| 3,973,854 | 8/1976 | Gilbo et al. | 403/176 X |
| 4,020,566 | 5/1977 | Dreiding | 446/126 X |
| 4,383,780 | 5/1983 | Davison | 403/219 |
| 4,495,380 | 1/1985 | Ryan et al. | 24/453 X |
| 4,843,976 | 7/1989 | Pigott et al. | 24/453 X |
| 5,007,636 | 4/1991 | Pagani | 446/77 X |

FOREIGN PATENT DOCUMENTS

| | | | |
|---|---|---|---|
| 3512306 | 10/1986 | Fed. Rep. of Germany | 446/108 |
| 949818 | 9/1949 | France | 446/111 |
| 74205 | 11/1960 | France | 446/126 |
| 9104775 | 4/1991 | PCT Int'l Appl. | 446/106 |
| 564979 | 10/1943 | United Kingdom | 446/122 |
| 565947 | 12/1944 | United Kingdom | 446/102 |

*Primary Examiner*—Robert A. Hafer
*Assistant Examiner*—D. Neal Muir
*Attorney, Agent, or Firm*—Antonelli, Terry, Stout & Kraus

[57] ABSTRACT

A construction kit is indicated which consists of elongated stave elements (2), which at their ends are provided with protruding plate portions (6, 10) with pins (8) and holes (12) for mutually rotatable end joining of the state elements in one and the same plane. The elements are primarily intended for being laid out as edge or outline markings, but they are provided with groove-shaped depressions (4), which by means of bonding blocks (32) also allow a stabilized stacking of the elements for forming spatial structures.

8 Claims, 2 Drawing Sheets

FIG.7
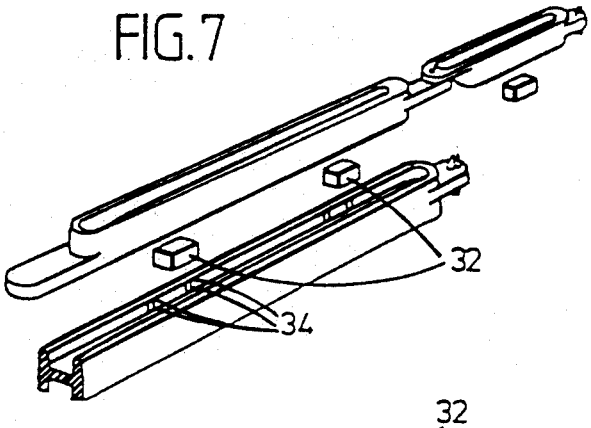
FIG.8
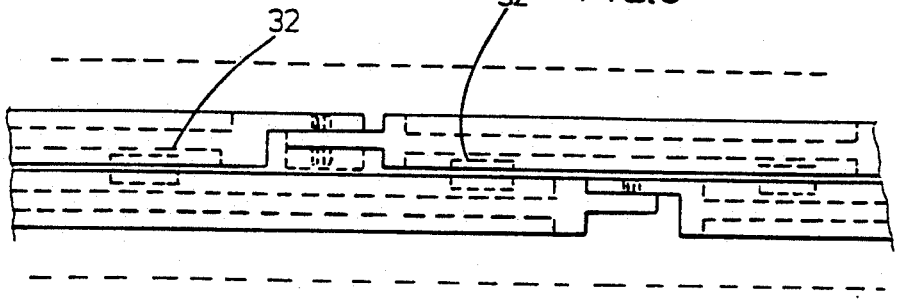
FIG.9
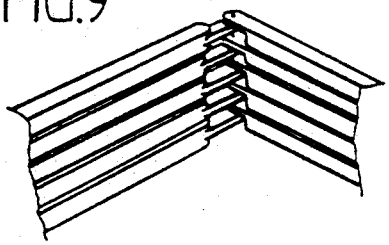
FIG.10
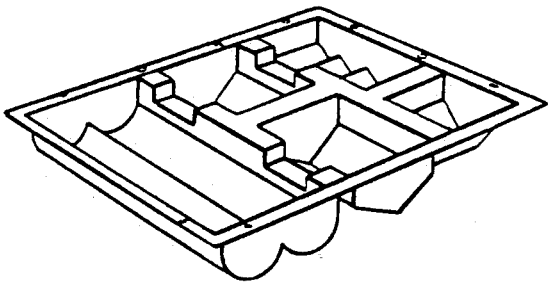
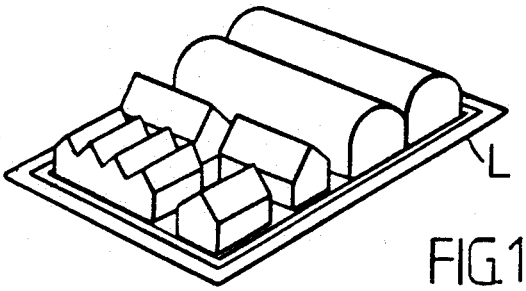
FIG.11

TOY CONSTRUCTION KIT

FIELD OF THE INVENTION

The present invention relates to a toy construction kit consisting of joinable, elongated elements.

BACKGROUND OF THE INVENTION

Construction kits are known which have different types of stave or plate strip elements, with which a spatial structure may be constructed, but these elements are not especially well suited for the simple purpose of merely being "line markers", e.g. for being laid out on a floor area for marking traffic lanes, harbour structures, building ground plans, etc.

When laying out such markings, children normally make do with available elongated objects such as rulers, sticks, string, pencils, etc., but in connection with the invention it is realized that there is a need for such marker elements of a more appropriate design.

SUMMARY OF THE INVENTION

The construction kit according to the invention comprises a number of stave elements of plastic material, the ends of which are provided with snaplock-like coupling means for rotatable coupling of the stave ends, which means are provided on plate portions which are outwardly projecting from the stave ends with a reduced thickness relative the stave thickness and at their outer ends are provided with either perpendicularly protruding snap lock pins or locking holes for cooperating with such pins, the plate portions provided with the locking pins being situated in a median plane of the stave elements and preferably having locking pins which project outwardly to both sides, while the plate portions which are provided with the locking holes are situated in extension of an upper or lower side area of the stave element, the thickness and location of the plate portions being adapted in such a manner that two endwise joined stave elements will generally be flush with one another.

For the desired primary use of the elements, two essential advantages are hereby obtained, viz. for one thing that the elements may be joined end by end in a rotatable manner such that they may be laid out in extension of each other in either a straight or a kinked manner, i.e. for obtaining line markings along large straight or curved stretches or with sharp angles, and for another thing that the joined elements will be positioned in the same plane, i.e. with both or all adjoining elements parallel with and engaging the support surface without using special, superposed joining members at the joined ends. A further and essential advantage will be that at the end joints, if desired, a third element may be added to the joint, as there will be sufficient space for adding such an element with its apertured plate portion situated at the opposite side of the central pin plate portion of the joint, such that star points may be established in the system, e.g. for allowing an element stretch to branch out perpendicularly or obliquely from a through-going straight stretch, with all three adjacent elements being positioned in one and the same plane. This possibility is particularly pertinent in connection with laying out a ground plan for a building, as it is hereby possible to mark partition walls which project out from an unbroken outer wall, but of course this option may be used for many other purposes.

Thus, in practice the elements should be about three times as thick as the said plate portions projecting out from the end portions, an appropriate thickness indication being about 10 mm, while the width, by way of example may be about 12 mm. An element of such cross-sectional dimensions will have a more than sufficient rigidity against bending in the vertical plane, and a fully sufficient rigidity will be obtainable even if both the upper and the lower side of each element is provided with a longitudinal groove, such that the desired total thickness is obtained by both sides of a thinner, elongated plate portion being provided at both edges with respective upwardly and downwardly projecting rib portions, which also economizes material. However, an especially important function of these edge ribs is to allow reception of upwardly or downwardly projecting holder block members which may be brought into holding engagement with the corresponding tracks between the edge ribs of respective over- and underlying elements, respectively, whereby the system acquires the further dimension that the elements may also be used as stackable building elements, e.g. for providing house walls or other vertical surfaces.

The said snap lock pins should project no further outwards than to the opposite upper and lower side planes of the elements, as they would otherwise obstruct a flat engagement of the elements against the surface on which they are laid out. When they are designed as snap lock pins they should be provided with expanded head portions which can cooperate with the locking holes, and according to the invention these conditions may be provided for by the locking holes being provided with outer extensions, which may receive the locking heads without the latter projecting outside the outer side of the plate portions in which the locking holes are provided. This implies moreover that elements which are laid out on top of each other may very well extend over or under end joints in the subjacent or superjacent row of elements, just as branch elements may branch out from these joints without interrupting the tight joinability of the elements.

BRIEF DESCRIPTION OF THE DRAWINGS

In the following the invention is explained in more detail with reference to the drawing, in which FIG. 7 is a perspective view for illustration of a vertical joinability of the elements according to the invention, FIG. 8 is a plane side view of a vertically erected structure, FIG. 9 is a perspective view of a spatial corner joint, and FIGS. 10 and 11 are perspective views of an associated kit tray, seen from above in its tray position, respectively.

DETAILED DESCRIPTION

Figure 1:
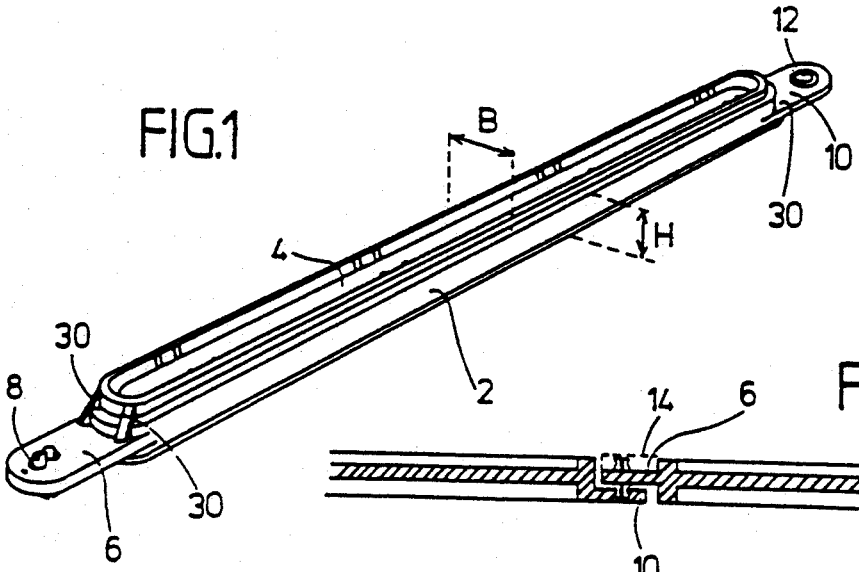
FIG. 1 is a perspective view of a single element according to the invention.

The element 2 shown in FIG. 1 is a die cast plastic stave of width B and height H, in the upper and lower side of which are provided longitudinal grooves 4, each by way of example having a depth of ⅓ H. At one end of the stave is provided a plate portion 6 outwardly projecting in the median plane and having a thickness of about ⅓ H and provided at both its upper and lower side with a vertical locking pin 8, which is described in more detail below. At its other end the stave 2 has a similar outwardly projecting plate portion 10, which however is not situated in the median plane, but in the lower side plane; while also having a thickness of about ⅓ H. This plate portion, which by turning the stave 2 upside down will be situated in the upper side plane of the stave, is provided with a locking hole 12 for cooperation with one of the locking pins 8 of an adjacent stave element.

Figure 2:
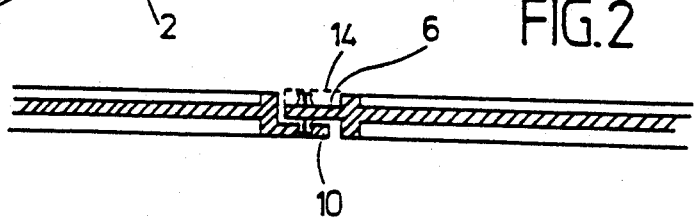
FIG. 2 is a longitudinal section through two such elements in a joined condition.

This is shown in more detail in FIG. 2, in which it will also be seen that the two joined elements will be flush with each other, such that they may be supported in a level manner on a common surface, e.g. a table or floor surface. A dotted line 14 indicates that the plate portion 10 may equally well be situated above and below the plate portion 6, without this changing the fact that the elements will be joined in direct extension of each other.

Thus, it is possible with such elements to build up an element row of any length, and with the pin-and-hole connections 8,12 the elements may freely be placed in direct extension of each other or with desired mutual angular turns; the plate portions 6 and 10 project relatively far outwards such that the elements may be placed not only in right angles but also in acute angles with each other, e.g. down to only about 30°.

Figure 3:
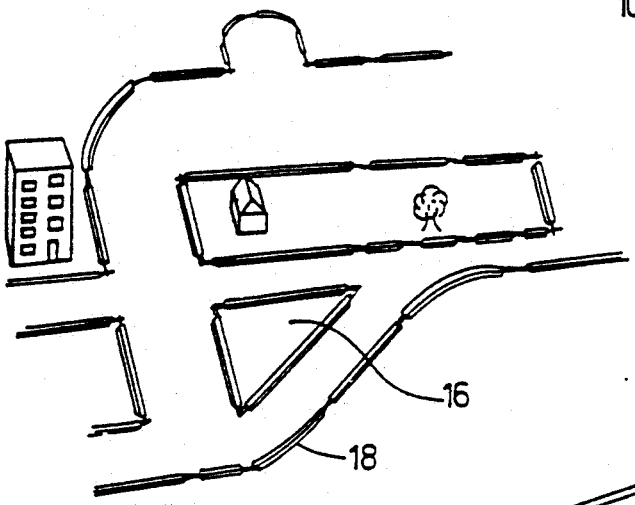
FIG. 3 is a perspective view of several of such elements laid out on a support surface.

In FIG. 3 is shown by way of example how such rows or joints of elements may be laid out for marking e.g. streets in connection with squares or closed areas, and the children may then play with toy vehicles on the marked street areas, and with trees and houses outside these areas. It is especially seen that an area 16 is formed by elements joined at acute angles and that the construction kit may also comprise stave elements 18 of a curved shape. Of course there could be provided elements shaped with right-angled or oblique-angled bends, but such bends may already be established by a turning out of joined, non-bent elements. It appears furthermore from FIG. 3 that the elements—and this may apply to both the straight and the curved elements—may be provided in different lengths and optionally also with different curves.

Figure 4:
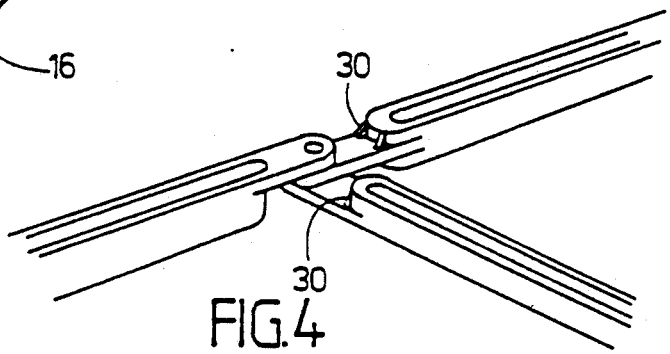
FIG. 4 is a perspective view of an element joint of three elements.
Figure 5:
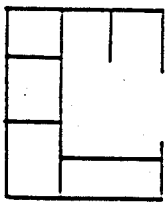
FIG. 5 is a plan view of a laid out building ground plan.

It has been mentioned that it is of no importance whether the plate portion 10 is placed above or underneath the plate portion 6, but as shown in FIG. 4 this has the significant consequence that one same joint may comprise as many as three stave elements which are all situated in the same plane, viz. with the plate portions 10 of two elements situated respectively above and beneath the plate portion 6 of the third element. Thus, firm branchings may be established, which may be very pertinent in connection with laying out markings of topographic details, but which is particularly pertinent for laying out building ground plans as shown e.g. in FIG. 5; it is widely used to play with house arrangements based on a ground plan of the house, and here the elements according to the invention may thus be of good use by allowing a clear marking of the ground plan.

Figure 6:
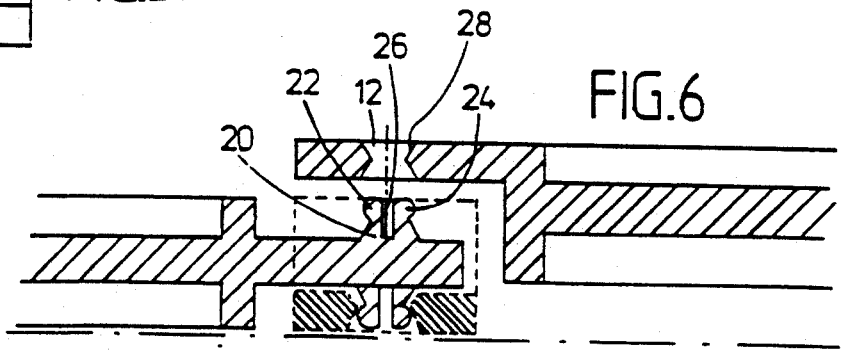
FIG. 6 is a longitudinal sectional view corresponding to FIG. 2, but more detailed.

In FIG. 6 it is shown in more detail that the locking pins 8 may have a foot portion 20 which is outwardly constricting, and a head portion 22 expanding therefrom and having an outwardly narrowing end portion 24, the single pins 8 moreover being provided with a transverse perforation 26 which makes the thus separated halves of the pin resiliently bendable against each other. Correspondingly the locking hole 12 is provided with a central constricted portion 28, the diameter of which is slightly smaller than the outer diameter of the locking head 22, such that a locking engagement may be established by inserting the hole 12 over the pin without this pin protruding from the respective upper or lower side of the plate portion 10; it is indicated in dotted lines that this plate portion may be placed underneath just as well as above the plate portion 6.

It is shown in FIGS. 1 and 4 that vertical inclined ribs 30 are provided at the transition area between the plate portions 10 and 6 and the respective thick ends of the stave elements 2. The function of these ribs is to allow an easier separation of the joined elements when locking heads 22 of a good locking effect are used; a release may then be brought about merely by a mutual rotation of the elements about the pin 8, until the angle between them gets so acute that the side edges of the plate portions 6 and 10 will hit these ribs 30, or rather the corresponding rib of the opposite element 2, and by a brief continuous rotation of the elements the rib or ribs 30 will then force the plate portions 6 and 10 from each other, whereby the locking engagement is released.

Even though the primary function of the elements is to provide line markings, they may, however, also be used as stackable building elements, the grooves 4 in the top and bottom side of the elements making it possible to effect a stacking assembling by means of intermediate holder blocks 32, as shown in FIGS. 7 and 8. In FIG. 8 it is also shown that such layers of elements may be stacked without regard to the position of the joints, as the thickness of the material at the joints is no different from the thickness along the elements in general.

However, it may of course be advantageous to let at least certain joints be placed directly above each other, e.g. when constructing house corners or partition wall connections as suggested in FIG. 9. In a house wall structure it is easy to provide apertures for doors and windows merely by omitting to place stave elements at the concerned areas.

It may be appropriate that the side walls of the grooves 4 are provided with protruding vertical rib portions 34 for marking the areas where the holder blocks 32 should preferably be placed.

In FIG. 10 is shown a box for receiving a set of the disclosed building elements. The bottom of the box is provided with various depressions in which may be received elements of various length and straight and curved elements, respectively. Especially from FIG. 11, in which this box is shown in inverted condition, it will be seen that the box depressions may constitute recognizable building structures whereby the box in itself may be comprised in a play arrangement on a suitable support. The box is provided as completely tight so that it may be used for playing with water, both as a floater and as a water container.

In FIG. 10 it is shown that on a protruding edge flange on the box there may be provided knobs, the length and width dimensions of which fit the width of the grooves 4, such that the stave elements may be connected to the box. When the base shape of the knobs is square the stave elements may be mounted along the box sides or perpendicularly protruding therefrom, while the elements may furthermore be outwardly or inwardly projecting in all directions when the knob shape is circular.

The lengths of the box sides are proportioned in such a manner that by use of some of the stave elements these may be joined and laid out as a structure on the box sides, e.g. with corner joints as shown in FIG. 9, and a transparent lid (L) associated to the box as shown in FIG. 11' may then be placed as a roof over the thereby constructed "hall".

Many different objects may very well be comprised in or added to the system and need merely be designed for being joined with or to the stave elements, e.g. erect fence portions or lamp posts for guided insertion into the grooves 4, or model houses which at their underside are provided with downwardly protruding pins 8 or holes 12 for cooperation with the corresponding locking means of the stave elements.

DESCRIPTION OF THE PREFERRED EMBODIMENT

In a preferred system use is made of three stave lengths with a length proportion of 1:2:4, the greatest length being 250 mm. The curved elements constitute ⅛ of a circle having a radius of 250 mm, and they are joinable into a circle having a diameter of 500 mm, whereby a diagonal consisting of two stave elements each of 250 mm may be placed in the circle. It has proved appropriate that each kit of stave elements comprise a few elements which have coupling holes 12 at both ends, and there may optionally also be used elements with pins 8 at both ends.

I claim:

1. A toy construction kit comprising elongated, joinable stave elements, wherein the elements include staves of plastic material, the staves having two ends, each of which are provided with snaplock-like coupling means adapted for rotatable coupling of joined staves, which snaplock-like coupling means are provided on plate portions which are outwardly projecting from stave ends with a reduced thickness relative to a thickness of the staves, wherein a plate portion is provided with identical integral locking pins adjacent an outward end of said plate portion, said plate portion being situated in a median plane of the stave element, such that one pin extends upwardly and one pin extends downwardly, wherein a further plate portion is provided with a locking hole adjacent an outward end of a further plate portion, said further plate portion on said other end of said stave being displaced from the median plane of the stave element, and wherein the thickness and location of the plate portions are adapted in such manner that two endwise joined stave elements will generally be planar with one another upon attachment to one pin and will allow a third stave element to be attached to the other of said pins with said third stave element being planar to said other stave elements.

2. A construction kit according to claim 1, wherein the plate portions are arranged in such a manner that in a junction three stave elements may be joined in one and the same plane.

3. A construction kit according to claim 1, wherein both an upper and a lower side of the stave elements are provided with groovelike depressions which define outwardly projecting edge ribs on both sides of each of several of the stave elements, and wherein the construction kit further comprises block members which may be inserted locally into the depressions in a suitably outwardly projecting manner to cooperate with a depression of an adjacent side of a superjacent or subjacent stave element.

4. A construction kit according to claim 1, wherein the locking hole is provided with a double-sided conical shape, the hole expanding to both sides of a constricted intermediate area, and wherein the locking pin has a length such that in each joint the locking pin will extend no further than an opposite end of a corresponding locking hole.

5. A construction kit according to claim 1, wherein the stave ends just above and below the plate portions which project out therefrom in the median plane are provided with outer side portions which extend obliquely inwards and forwards towards the outwardly projecting plate portion.

6. A construction kit according to claim 1 further comprising a sectioned storage box for groups of stave elements of different lengths or shapes, wherein at least one of a rim area of the box or an associated box lid is provided with means which allow an efficient joining with stave elements of the construction kit.

7. A construction kit according to claim 6, wherein the box is made of a shell material, the shell material having depressions constituting element receiving sections, and wherein said receiving sections form upstanding, recognizable structures such as buildings with characteristic roof shapes when the box is placed upside down.

8. A construction kit according to claim 1, wherein the plate portion situated in the median plane of the stave element has locking pins which project outwardly to both sides.

* * * * *